US006496664B1

(12) United States Patent
Ogata et al.

(10) Patent No.: US 6,496,664 B1
(45) Date of Patent: Dec. 17, 2002

(54) IMAGE FORMING APPARATUS COMPRISING STORING MEANS FOR STORING INFORMATION THAT A SETTING OPERATION IS PERFORMED

(75) Inventors: Hiroaki Ogata, Shizuoka-ken; Seiji Yamaguchi, Numazu; Masao Uyama, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/662,131

(22) Filed: Sep. 14, 2000

(30) Foreign Application Priority Data

Sep. 17, 1999 (JP) ..... 11-263135
Sep. 5, 2000 (JP) ..... 2000-268828

(51) Int. Cl.[7] ..... G03G 15/08
(52) U.S. Cl. ..... 399/62; 399/30; 399/106
(58) Field of Search ..... 399/12, 13, 24, 399/25, 27, 29, 30, 55, 58, 59, 61, 62, 63, 64

(56) References Cited

U.S. PATENT DOCUMENTS 5,475,471 A 12/1995 Kisu et al.
5,534,344 A 7/1996 Kisu et al. ..... 428/323
5,546,167 A 8/1996 Ogata et al.
5,678,141 A 10/1997 Asano et al. ..... 399/115
5,710,956 A * 1/1998 Kurohata et al. ..... 399/24
5,745,822 A * 4/1998 Nishimura et al. ..... 399/106
5,835,818 A 11/1998 Hoshika et al. ..... 399/26
6,131,007 A 10/2000 Yamaguchi et al. ..... 399/256
6,137,970 A * 10/2000 Sasago ..... 399/106

* cited by examiner

*Primary Examiner*—Hoang Ngo
(74) *Attorney, Agent, or Firm*—Fitzpatrick, Cella, Harper & Scinto

(57) ABSTRACT

A cartridge detachably mountable to a main body of an image forming apparatus which has a developing device for developing an electrostatic image formed on an image bearing member with two-component developer includes a toner and a carrier. The developing device has a density detecting portion for detecting toner density of a start agent of the developer and the main body of the apparatus performs a setting operation for setting a control value for controlling the density detecting portion on the basis of a detection result of the density detecting portion and storing device for storing information that the setting operation is performed.

19 Claims, 5 Drawing Sheets

IMAGE FORMING APPARATUS COMPRISING STORING MEANS FOR STORING INFORMATION THAT A SETTING OPERATION IS PERFORMED

BACKGROUND OF THE INVENTION

1. Field of the Invention

The present invention relates to an image forming apparatus of electrophotographic type such as an electrophotographic copying machine, an electrophotographic printer (for example, laser beam printer, LED printer or the like), a facsimile or a word processor, and a cartridge detachably attachable (mountable) to a main body of such an image forming apparatus.

2. Related Background Art

In conventional image forming apparatuses of the electrophotographic type, for example, a process cartridge in which developing means, an electrophotographic photosensitive member and process means acting on the photosensitive member are integrally incorporated as a cartridge unit, which can detachably be mounted to a main body of the image forming apparatus, has been used. According to such a process cartridge, since the maintenance of the apparatus can be effected by an operator himself without any serviceman (expert), the operability is enhanced considerably. Thus, the process cartridge has widely been used in the image forming apparatus.

However, the process cartridge has a limitation in a toner capacity and also has the following disadvantages.

That is to say, in case of an image forming apparatus permitting heavy duty operation, if a process cartridge having less toner capacity is used, since the frequency of exchange of process cartridges is increased, usability will be worsened. Further, when the process cartridge is exchanged for a new one, since constructural elements in the cartridge other than toner are also exchanged together, the running cost will be increased.

Thus, a so-called toner supplying system in which only toner is supplied and developing means and the like are provided in the main body has mainly been used in the heavy-duty copying machine. The disadvantage of the toner supplying system is that the maintenance of the apparatus, such as exchange of consumption (worn) part(s), can almost not be performed by the operator himself, requiring the expert for maintenance.

Recently, a process cartridge of the toner supplying type having advantages of both the process cartridge system and the toner supplying system has been proposed. An image forming apparatus using such a process cartridge of toner the supplying type includes a process cartridge comprising developing means for visualizing an electrostatic latent image formed on an image bearing member with toner, and a toner supplying unit for supplying a predetermined amount of toner to the developing means.

By the way, the developing means include two-component developer including toner and a carrier and toner density detecting means for detecting toner density (mixing ratio between the toner and the carrier) so that the toner density is maintained to a constant value by supplying the toner from the toner supplying unit in accordance with a detection value of the toner density detecting means.

Further, the developing means includes a start agent containing portion containing start agent in which the toner and the carrier are mixed together at a predetermined ratio and isolated from a developing portion by a seal member in order to prevent the start agent from leaking during transportation, and, when the process cartridge is newly used by the operator, the start agent can be supplied from the start agent containing portion by shifting the seal member.

It is desirable that the dispersion in detection outputs of respective process cartridges each having the toner density detecting means is corrected by measuring the toner density of the start agent in which the toner and the carrier are previously mixed together at a predetermined ratio by means of the toner density detecting means in the initiation of usage of the process cartridge. By using the correction sequence as an initial setting sequence of the process cartridge, the dispersion in detection output of the toner density detecting means with respect to the predetermined toner density can be corrected.

However, there is a case where the process cartridge is once dismounted from the main body of the image forming apparatus on the way and then is mounted to the main body again. In this case, if the correction sequence is effected again in the re-mounting, the waiting time will be increased to increase time loss. Further, since the toner density of the process cartridge on the way has slight dispersion in comparison with the toner density of the start agent, if the correction of the detection output of the toner density detecting means of the process cartridge being used is effected, the dispersion in detection output of the toner density detecting means for respective process cartridges may not be reflected correctly.

SUMMARY OF THE INVENTION

An object of the present invention is to provide a cartridge and an image forming apparatus, in which the above-mentioned correction sequence is effected only once for each cartridge.

Another object of the present invention is to provide a cartridge and an image forming apparatus, in which the waiting time can be reduced by avoiding repeated execution of a correction sequence.

A further object of the present invention is to provide a cartridge and an image forming apparatus, in which dispersion in detection output of toner detecting portions of respective cartridges can be corrected with high accuracy.

The other object of the present invention is to provide a cartridge and an image forming apparatus, in which information regarding execution of the correction sequence is stored in the cartridge.

DETAILED DESCRIPTION OF THE PREFERRED EMBODIMENTS

The present invention will now be explained in connection with embodiments thereof with reference to the accompanying drawings.

Figure 1:
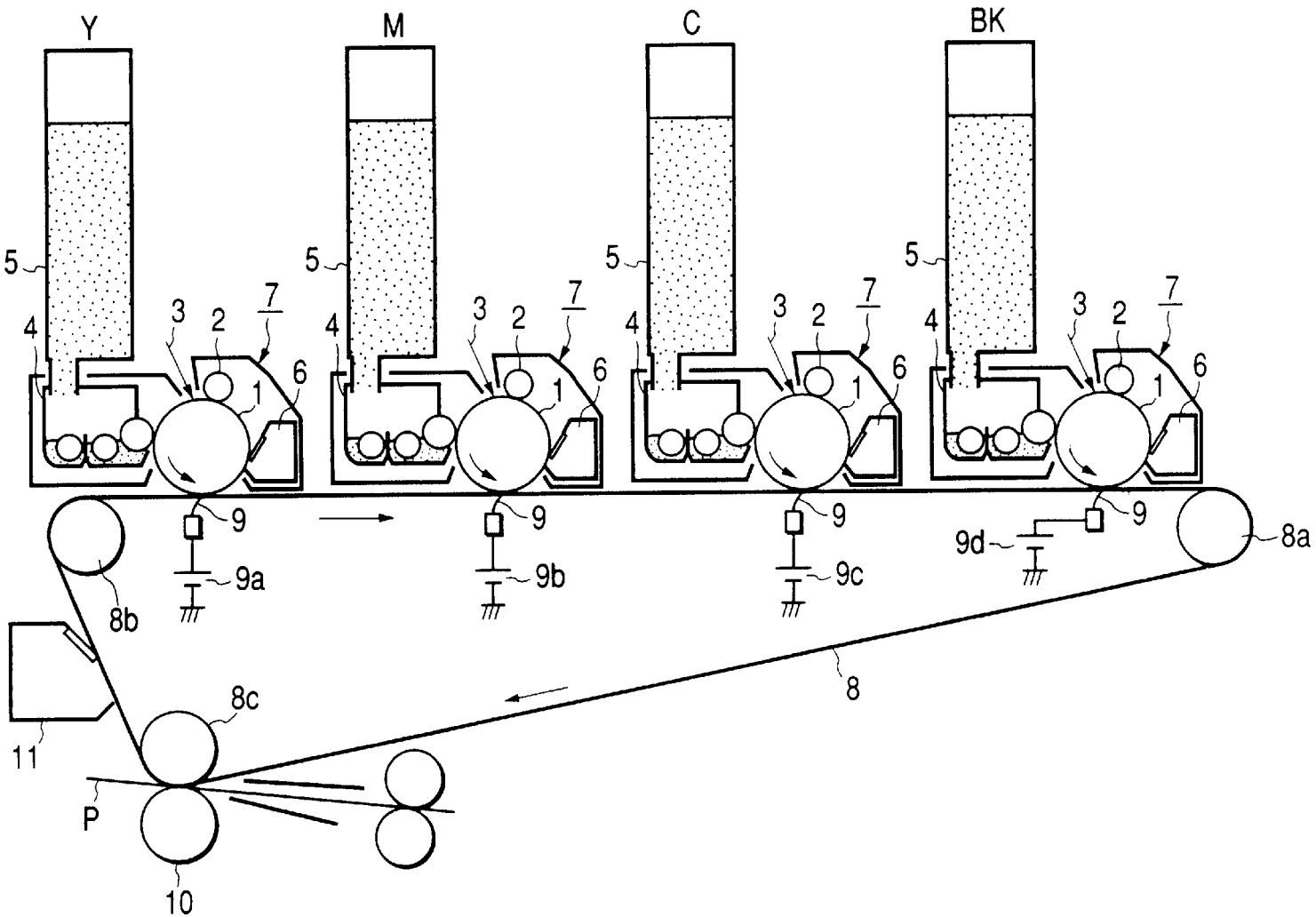
FIG. 1 is a schematic sectional view of an image forming apparatus according to the present invention.
Figure 2:
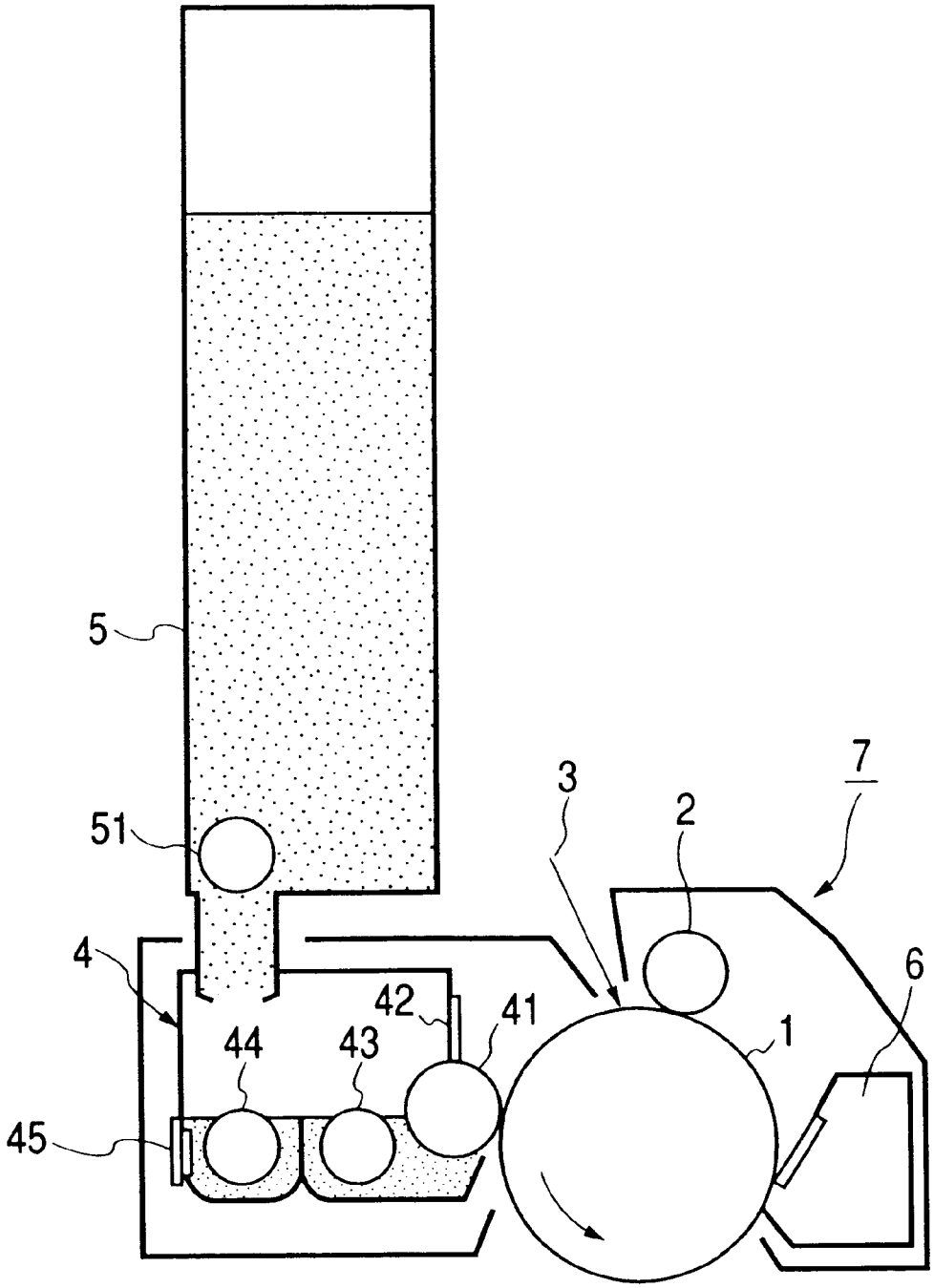
FIG. 2 is a schematic sectional view showing a process cartridge and a developer supplying unit of the image forming apparatus according to the present invention.
Figure 3:
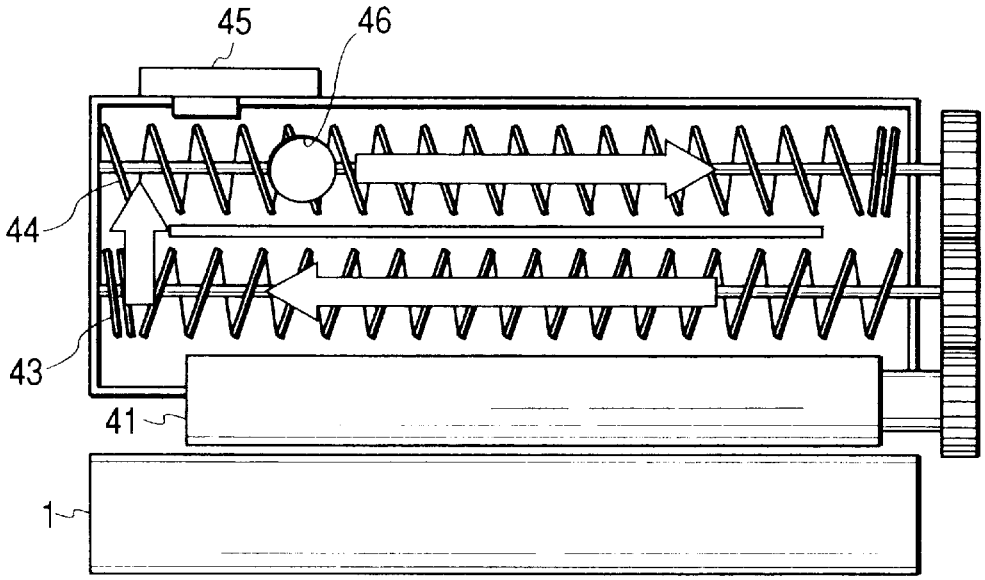
FIG. 3 is a sectional plan view of a developing device of the image forming apparatus according to the present invention.

FIG. 1 is a schematic sectional view of an image forming apparatus according to the present invention, FIG. 2 is a schematic sectional view showing a process cartridge and a developer supplying unit of the image forming apparatus, and FIG. 3 is a sectional plan view of a developing device.

The image forming apparatus according to the illustrated embodiment is embodied as a color laser printer utilizing an electrophotographic process, and, as shown in FIG. 1, is of four-drum type (in-line type) capable of obtaining a full-color print image by successively transferring various color (i.e., yellow (Y), magenta (M), cyan (C) and black (Bk)) toner images formed in a plurality of process cartridges 7 onto an intermediate transfer belt 8 as a second image bearing member in a superimposed fashion once. The endless intermediate transfer belt 8 is mounted on a drive roller 8*a*, a tension roller 8*b* and a secondary transfer counter roller 8*c* and is rotated in a direction shown by the arrow in FIG. 1, and the process cartridges 7 for various colors are arranged in series with respect to the intermediate transfer belt 8.

Now, the process cartridge 7 will be described with reference to FIG. 2.

A photosensitive drum 1 disposed within the process cartridge 7 for effecting development with yellow toner is uniformly charged by a primary charging roller 2 with predetermined polarity and potential and then is subjected to image exposure 3 from image exposing means (not shown) (for example, a color decomposing and focusing exposure optical system for a color original image or a scan exposure system of laser scan type for outputting a laser beam modulated in response to a time-lapse electric digital pixel signal of image information), thereby forming an electrostatic latent image corresponding to a target first color component image (yellow component image).

Then, the electrostatic latent image is developed by a first developing device (yellow developing device) 4 with a first color or yellow color to be visualized as a yellow image.

Now, the developing device 4 will be described with reference to FIGS. 2 and 3.

The developing device 4 is a two-component developing apparatus of the contact type (two-component magnet brush developing apparatus) in which developer including a carrier and toner is held on a developing sleeve 41 as a developer carrying member having a magnet roller therein. A developer regulating blade 42 is opposed to the developing sleeve 41 with a predetermined gap therebetween, and the developer regulating blade 42 serves to form a thin developer layer on the developing sleeve 41 as the developing sleeve 41 is rotated.

The developing sleeve 41 is opposed to the photosensitive drum 1 with a predetermined gap therebetween, and, during the development, the thin developer layer formed on the developing sleeve 41 is contacted with the photosensitive drum 1 to be supplied thereto. Incidentally, in the illustrated embodiment, negatively charged toner having an average particle diameter of 6 $\mu$m is used as the toner and magnetic carrier having average particle diameter of 35 $\mu$m and a saturation magnetization of 205 emu/cm$^3$ ($205\times4\pi\times10^{-4}$= $8.2\ \pi\times10^{-2}$ Wb/m$^2$) is used as the carrier. Further, the developer is obtained by mixing the toner and the carrier with a weight ratio of 8:92.

Further, agitating screws 43, 44 for agitating the developer are disposed within the developing device 4, and these agitating screws 43, 44 are rotated in synchronism with rotation of the developing sleeve 41 to agitate the supplied toner and carrier thereby to provide predetermined triboelectricity. Incidentally, although FIG. 3 shows a circulating condition of the developer and a longitudinal arrangement, as shown, the developer is circulated in a direction shown by the arrow as the agitating screws 43, 44 are rotated.

By the way, a toner density detecting sensor 45 as a toner density detecting portion for detecting the toner density in the developer by detecting a change in permeability of the developer is provided on an upstream side wall of the agitating screw 44 of the developing device 4, and a toner supplying port 46 is disposed at a slight downstream side of the toner density detecting sensor 45.

After the development, the developer is carried to the toner density detecting sensor 45 to detect the toner density by the sensor 45, and, in accordance with a detection result, the toner is supplied from the developer supplying unit 5 through the toner supplying port 46 of the developing device 4 in order to keep the toner density in the developer constant. The supplied toner is carried in a direction shown by the arrow in FIG. 3 by means of the agitating screw 44. After the toner is mixed with the carrier to provide the moderate triboelectricity, the developer is carried to the vicinity of the developing sleeve 41 to form the thin developer layer thereon for preparation for the development. Incidentally, as shown in FIG. 2, a toner supplying screw 51 is disposed within the developer supplying unit 5 so that the toner supplying amount is controlled by the number of rotations (rotating time) of the toner supplying screw 51.

In FIG. 1, the yellow image formed on the photosensitive drum 1 is advanced to a primary transfer nip portion between the photosensitive drum and the intermediate transfer belt 8. In the primary transfer nip portions, flexible electrodes 9 abut against a rear surface of the intermediate transfer belt 8. The flexible electrodes 9 have respective primary transfer bias power supplies 9*a* to 9*d* to permit independent application of bias at respective ports.

The yellow image is first transferred on to the intermediate transfer belt 8 at the first color port, and, then, a magenta image, a cyan image and a black image formed on the respective photosensitive drums 1 in a similar manner are successively transferred onto the intermediate transfer belt in a superimposed fashion at respective ports.

Four color images formed on the intermediate transfer belt 8 in this way are collectively transferred onto the transfer material P by the secondary transfer roller 10, and the transfer material P is subjected to fixing for a full-color image in a fixing device (not shown) to obtain the color print image. Incidentally, secondary transfer residual toner remaining on the intermediate transfer belt 8 is removed by an intermediate transfer belt cleaner 11 to clean the intermediate transfer belt 8 for preparation for the next image formation operation.

By the way, as material for the intermediate transfer belt 8, expandable/contractable material is not desirable in order to improve registration at the respective ports, but a resin group or a rubber belt with a metal core or a resin plus rubber belt is desirable. In the illustrated embodiment, a resin belt (having a thickness of 80 $\mu$m, a longitudinal length of 320 mm and a circumferential length of 900 mm) obtained by dispersing carbon in PI (polyimide) and controlling volume resistivity to the order of $10^8\Omega\cdot$cm is used.

Further, as each of the flexible electrodes 9, carbon dispersed high density polyethylene having sufficient flexibility and anti-wear ability and capable of being controlled to low resistance is used. The resistance is selected to be $10^4\Omega\cdot$cm or less, the thickness is selected to be 500 $\mu$m and the longitudinal length is selected to be 315 mm to avoid leaking with respect to the photosensitive drums 1.

Now, imaging conditions will be described.

Dark potential on photosensitive drum (potential of non-imaged portion due to primary charging):

Vd=−600 V

Light (Bright) potential (potential of imaged portion due to laser exposure): V1=−150 V Developing method: magnetic two-component magnet brush development Developing bias: Vdc=−400 V, Vac=1800 Vpp, frequency=2300 Hz Process speed: 117 mm/sec Primary transfer bias: first color: +400 V second color: +400 V third color: +400 V fourth color: +400 V Through-put for plain paper in the printer according to the illustrated embodiment is letter size lateral (216 mm) feeding/24 ppm, and an image distance (sheet interval) is 80 mm.

Now, the gist of the present invention will be explained.

Figure 4:
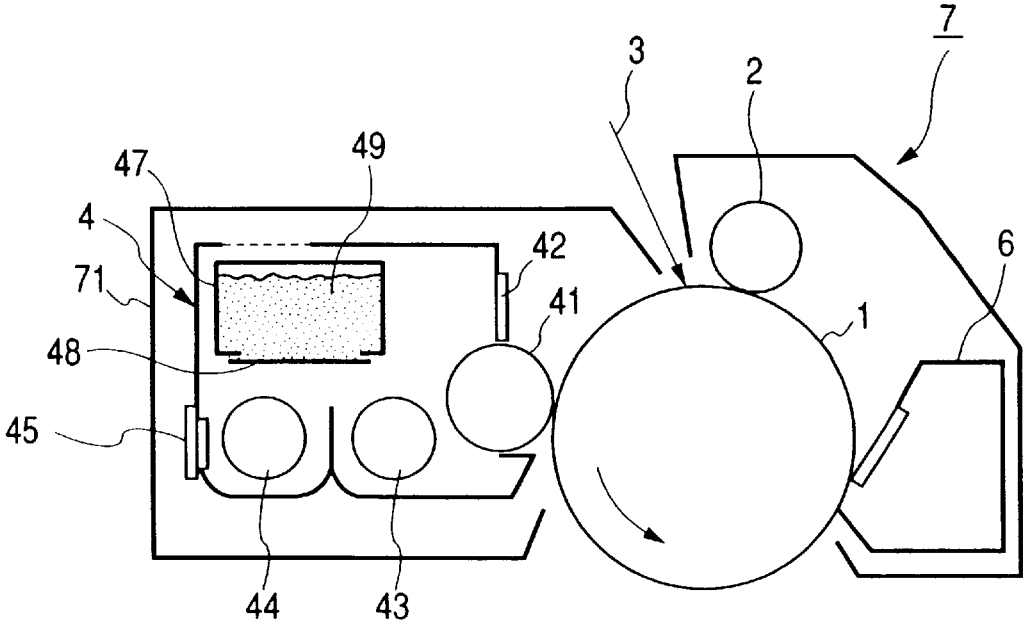
FIG. 4 is a sectional view showing a condition of the process cartridge of the image forming apparatus according to the present invention before the start of using the process cartridge.
Figure 5:
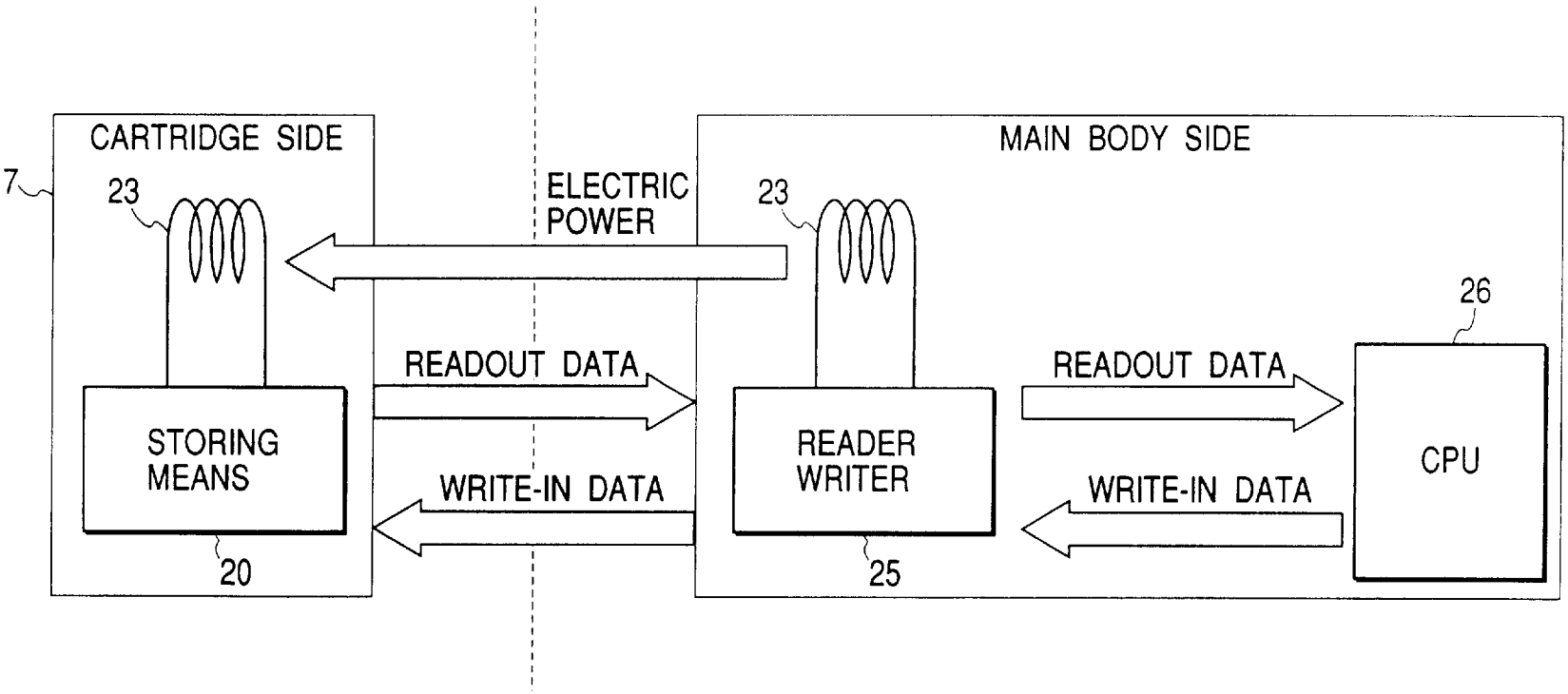
FIG. 5 is a schematic constructural view showing a memory of non-contact type.

FIG. 4 is a sectional view showing the process cartridge 7 in which the photosensitive drum 1, the developing device 4, the primary charging roller 2 and the cleaner 6 are enclosed by the cover 7 as a cartridge unit, before usage, and FIG. 5 is a constructural view showing a memory of non-contact type.

A start agent containing portion 47 for containing start agent 49 obtained by previously mixing the toner and the carrier at a predetermined constant ratio (in the illustrated embodiment, the weight ratio of toner to the carrier is 8:92) is disposed above the agitating screws 43, 44 of the developing device 4 of the process cartridge 7. The start agent 49 is contained to be isolated from a developing portion by a seal member 48 in order to prevent toner leakage during transportation. When the process cartridge 7 is newly used, by unsealing the seal member 48 by the operator, the start agent 49 can be supplied from the start agent containing portion 47 to the developing portion. Incidentally, in the illustrated embodiment, while the seal member 48 adhered to a start agent supplying port and capable of being peeled was used, a seal member of the slide type covering the start agent supplying port and capable of being shifted upon usage may be used.

By the way, as shown in FIG. 5, memory means as means for storing information is provided on the process cartridge 7, and information regarding use/non-use of the process cartridge 7, the correction value of the toner density detecting sensor 45 and the using amount of the process cartridge 7 are stored in the memory means 20. Incidentally, although the memory means 20 used in the present invention may be of any type so long as it can store and hold the signal information in a re-writing manner, for example, electrical means such as RAM or ROM having a re-writing ability, or magnetic memory means such as a magnetic recording medium, a magnetic bubble memory or a photo-magnetic memory is used.

In FIG. 5, by combining an antenna 23 with a resonance circuit comprised of a capacitor (not shown), since an operating power source is formed from an electromagnetic wave sent from a reader line 25, the communication can be effected without providing any power supply on the process cartridge.

Although a non-volatile memory is provided on the process cartridge 7, in the illustrated embodiment, a typical non-volatile memory of ferro-dielectric type (referred to as "FeRAM" hereinafter) 20 is used.

Data sent from a CPU 26 of the main body of the image forming apparatus is stored in the FeRAM 20 by using the reader line 25, and the information in the FeRAM 20 is sent to the CPU 26.

There is dispersion in detection output between the toner detecting sensors 45 of the respective cartridges. That is to say, regarding the start agent having a constant toner density, the detection output values of the toner density detecting sensors 45 of the respective cartridges are slightly varied. Accordingly, in the initiation of usage of process cartridges, the toner density is measured by the sensors of the cartridges with respect to the start agent having the constant toner density, and the dispersion in detection outputs of the sensors 45 of the respective cartridges is corrected. A correction sequence for effecting the correcting operation for correcting the dispersion in detection output of the sensor 45 is set as a process cartridge initial setting sequence. A correction value as a control value for controlling the sensor 45 is set by the correction sequence.

The correction value is written and stored in the memory of the main body of the image forming apparatus or the process cartridge, and information capable of discriminating the fact that the process cartridge initial setting sequence was effected is written in the memory of the process cartridge. By reading such information, even if the process cartridge is dismounted and mounted again on the way, the process cartridge initial setting sequence is not effected again, thereby reducing the waiting time up to the print permitting condition and not re-writing the correction value of the toner density detecting sensor. With this arrangement, the maintenance and usability can be enhanced and a low running cost can be achieved.

In the illustrated embodiment, since the process cartridge is provided with the seal member, after the seal member was shifted (for example, pulled out), the process cartridge must be used.

However, if it is not detected whether the start agent is supplied to the developing portion by shifting the seal member of the start agent containing portion of the process cartridge, the detection output of the toner density detecting sensor cannot be measured correctly. That is to say, if the process cartridge initial setting sequence is effected in a condition that the seal member is not shifted and the start agent is not supplied to the developing portion, the output correction of the toner density detecting sensor is effected in a condition that there is no start agent, with the result that the wrong correction value is stored, thereby making the subsequent correct toner density control impossible.

Further, since the information regarding the fact that the process cartridge initial setting sequence was effected is written in the memory of the process cartridge, even when the operator shifts the seal member again and mounts the process cartridge again, because the initial setting sequence is not effected, the restoring of the condition is impossible.

Accordingly, as will be described below, if the start agent is not supplied sufficiently in the initial usage of the process cartridge, such fact can surely be detected and the operator can be informed.

That is to say, when the main body of the image forming apparatus judges that the start agent is supplied to the developing portion on the basis of the detection result of the toner density detecting sensor, the above-mentioned correction sequence is effected; whereas, if the main body of apparatus judges that the start agent is not supplied to the developing portion, the main body of apparatus inhibits the correction sequence. Further, if the main body of apparatus judges that the start agent is not supplied to the developing portion, the fact that the seal member is not unsealed is displayed on the main body of apparatus to inform the operator of such fact.

Figure 6:
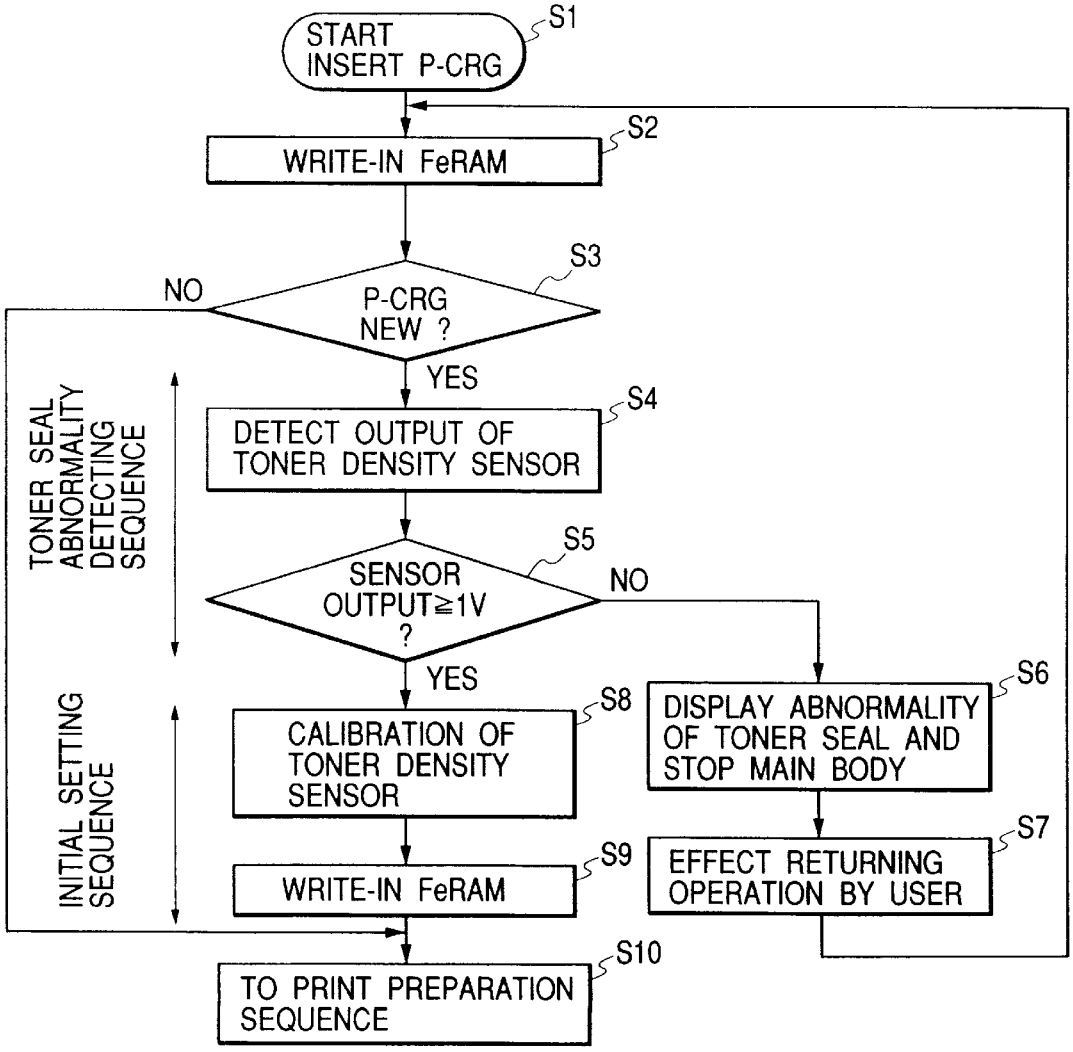
FIG. 6 is a flow chart showing a sequence until an initial setting sequence of the process cartridge is carried out in the image forming apparatus according to the present invention.

FIG. 6 is a flow chart showing a sequence until the initial setting sequence of the process cartridge 7 is carried out on the basis of the judgement of the condition of the process cartridge 7 in the color laser printer apparatus according to the illustrated embodiment.

First of all, the process cartridge (P-CRG) 7 is mounted to the main body of the image forming apparatus (step S1). As a result, the main body of the image forming apparatus judges that the process cartridge 7 was mounted, and, when the image forming apparatus reaches its operation permitting condition, the information for judging whether the mounted process cartridge 7 is new or old is read-in from the FeRAM 20 as the memory means of the process cartridge 7 (step S2), and the main body of the apparatus judges whether the process cartridge 7 is new or old (step S3). If it is judged that the process cartridge 7 has already been used, the program goes to the normal print preparation sequence (step S10).

On the other hand, if it is judged that the process cartridge 7 is new, the main body of the apparatus executes a toner seal abnormality detecting sequence. In the toner seal abnormality detecting sequence, first of all, the agitating screws 43, 44 are driven to circulate the start agent 49 which would be supplied from the start agent containing portion 47 within the developing device 4. At a timing that the start agent 49 is adequately sent around the toner density detecting sensor 45, the main body of the apparatus drives the toner density detecting sensor 45 to detect its output (step S4), and, it is judged whether the detection value is greater than the predetermined value (1V) or not (step S5).

If the output of the toner density detecting sensor 45 is smaller than the predetermined value (1 V), it is judged that the start agent 49 is not supplied to the developing device 4 adequately, and the CPU 26 displays the fact that the shifting of the seal member 48 is forgotten or the toner seal is abnormal and inhibits a further image forming operation (step S6). After the operator's restoring operation is ascertained by the detection of mounting/dismounting of the process cartridge 7 or the like, the inhibition of the image forming operation is released (step S7). Incidentally, in the illustrated embodiment, even before the output correction, since the output of the toner density detecting sensor 45 is outputted in a range of 1.5 to 3.5 V in the measurement of the start agent, it is set so that the toner seal abnormality is judged if the output is smaller than a threshold value of 1 V.

On the other hand, if the output is equal to or greater than 1 V and the start agent 49 is correctly supplied, the CPU 26 of the main body of the image forming apparatus executes the process cartridge initial setting sequence. In the initial setting sequence, the following process is mainly carried out.

Since the toner density detecting sensor 45 creates dispersion in output in dependence upon its attachment position, as well as its own dispersion, it is required that the control voltage of the toner density detecting sensor 45 of each process cartridge 7 be adjusted and set. That is to say, the agitating screws 43, 44 are driven to circulate the start agent (obtained by previously mixing the toner and the carrier at the weight ratio of 8:92) within the developing device 4, and the toner density detecting sensor 45 is operated. In this case, the main body of the apparatus executes calibration in which the control voltage of the toner density detecting sensor 45 is changed and a point that the output value of the sensor coincides with a predetermined constant value (2.5 V in the illustrated embodiment) is sought (step S8). The control voltage in this case is set as the control voltage of the toner density detecting sensor 45 of this process cartridge 7.

The image forming apparatus writes-in the information (information regarding whether the process cartridge is new or old) indicating the fact that the control voltage after the correction to be sought and the initial setting sequence was finished in the FeRAM 20 of the process cartridge 7 via the memory means (step S9). The initial setting sequence of the process cartridge 7 is finished in this way, and the image forming apparatus executes the print preparation sequence (step S10).

Incidentally, it may be designed so that a specific value (not belonging to the control voltage) is previously written in the memory area (for the control voltage of the toner density sensor) of the memory of the process cartridge and whether the process cartridge is new or old is judged by judging whether the correct value is written in such memory area (for the control voltage of the toner density sensor) in the new/old judgement of the process cartridge. Alternatively, because of the limitation of memory capacity of the process cartridge, the memory of the process cartridge may have only new/old information, and the correction value of the control voltage of the toner density detecting sensor may be stored in the main body of the image forming apparatus, or means (such as the new/old judging resistance) capable of new/old judging may be provided on the process cartridge, independently from the memory.

According to the illustrated embodiment, the information regarding the fact that the shifting of the seal member 48 of the start agent containing portion 47 is forgotten or regarding the poor opening/closing of the seal member 48 can be communicated to the operator without additionally providing a seal member shift detecting means, and, erroneous operations such as subsequent correction value error detection and fault initial setting sequence re-operation can be prevented, thereby enhancing maintenance and usability and reducing the running cost.

Further, in the illustrated embodiment, while an example that the cartridge has the photosensitive drum and the developing device was explained, the photosensitive drum may not be provided in the cartridge.

What is claimed is:

1. An image forming apparatus comprising:

a cartridge detachably mountable to a main body of the image forming apparatus, said cartridge including:

a developing device for developing an electrostatic image formed on an image bearing member with two-component developer including toner and a carrier, said developing device having a density detecting portion for detecting the toner density of a start agent of the developer and said main body of the apparatus performing a setting operation for setting a control value for controlling said density detecting portion on the basis of a detection result of said density detecting portion; and storing means for storing information that the setting operation is performed;

wherein said main body of the apparatus includes control means for performing the setting operation, wherein said developing device has a developing portion including a developer carrying member for carrying the developer at a developing position, a containing portion for containing the start agent, and a seal member for unsealable sealing in order to separate the start agent contained in said containing portion from said developing portion, wherein the start agent can be supplied to said developing portion by unsealing said seal member, wherein said density detecting portion is provided within said developing portion, wherein said main body of the apparatus judges that the start agent is supplied to said developing portion on the basis of the detection result of said density detecting portion, wherein, when said main body of the apparatus judges that the start agent is supplied to said developing portion on the basis of the detection result of said density detecting portion, said control means performs the setting operation, wherein, when said main body of the apparatus judges that the start agent is not supplied to said developing portion on the basis of the detection result of said density detecting portion, said control means inhibits the setting operation.

2. An image forming apparatus according to claim 1, wherein said storing means stores information of the control value after the setting operation is performed.

3. An image forming apparatus according to claim 1, wherein said storing means stores information whether said cartridge is new or not.

4. An image forming apparatus according to claim 1, wherein, when information that said cartridge is new is stored in said storing means, said main body of the apparatus performs the setting operation, and, when the information regarding the fact that said cartridge is new is not stored in said storing means, said main body of the apparatus does not perform the setting operation.

5. An image forming apparatus according to claim 1, wherein dispersion in detection output of said density detecting portion of each of said cartridge is corrected by the setting operation.

6. An image forming apparatus according to claim 1, wherein, when said main body of the apparatus judges that the start agent is not supplied to said developing portion on the basis of the detection result of said density detecting portion, said main body of the apparatus displays a fact that said seal member is not unsealed.

7. An image forming apparatus according to any one of claims 1 to 4, wherein said main body of the apparatus judges whether said cartridge is new or not, on the basis of whether information of the control value is stored in said storing means or not.

8. An image forming apparatus according to claim 1, wherein said storing means includes a memory.

9. An image forming apparatus according to claim 1, said cartridge includes said image bearing member.

10. An image forming apparatus comprising:

a cartridge detachably mountable to a main body of the image forming apparatus, said cartridge including:

a developing device for developing an electrostatic image formed on an image bearing member with developer having toner and a carrier, said developing device having a density detecting portion for detecting the toner density of a start agent of the developer and said main body of the apparatus performing a setting operation for setting a control value for controlling said density detecting portion, based on a detection result of said density detecting portion, and a developing portion having a developer carrying member for carrying the developer at a developing position, and a containing portion for containing the start agent; and storing means for storing information that the setting operation is performed;

wherein said main body of the apparatus includes control means for performing the setting operation, and wherein said control means effects the setting operation when the information is not stored by said storing means and the detection result of said density detecting portion is within a predetermined range, and the setting operation is prohibited by said control means when the information is not stored by said storing means and the detection result of said density detecting portion is beyond the predetermined range.

11. An image forming apparatus according to claim 10, wherein said storing means stores information of the control value after the setting operation is performed.

12. An image forming apparatus according to claim 10, wherein the setting operation is not effected when the information is stored by said storing means.

13. An image forming apparatus according to claim 10, wherein dispersion in detection output of said density detecting portion of each of said cartridge is corrected by the setting operation.

14. An image forming apparatus according to claim 10, wherein said developing device has an unsealable seal member for sealing to separate the start agent contained in said containing portion from said developing portion, wherein the start agent can be supplied to said developing portion by unsealing said seal member.

15. An image forming apparatus according to claim 14, wherein said main body of the apparatus displays that said seal member is not unsealed when the detection result of said density detecting portion is beyond the predetermined range.

16. An image forming apparatus according to claim 10, wherein said density detecting portion is provided within said developing portion.

17. An image forming apparatus according to claim 10, wherein said main body of the apparatus judges that the start agent is supplied to said developing portion when the detection result of said density detecting portion is within the predetermined range.

18. An image forming apparatus according to claim 10, wherein said storing means includes a memory.

19. An image forming apparatus according to claim 10, said cartridge includes said image bearing member.

* * * * *